United States Patent [19]

Annoni et al.

[11] 4,264,042

[45] Apr. 28, 1981

[54] UNIVERSAL SHAFT FOR THE REWINDING OF ADHESIVE MATERIAL AS TAPE CUT ON SLITTING/RE-REELING MACHINE

[76] Inventors: Eliseo Annoni, Via Fratellanza, 4 -Bollate -Milano; Romano Stefanoni, Via Fiume, 10-Nova Milanese -Milano, both of Italy

[21] Appl. No.: 31,947

[22] Filed: Apr. 20, 1979

[30] Foreign Application Priority Data

Sep. 12, 1978 [IT] Italy ..... 27541 A/78

[51] Int. Cl.[3] ..... B65H 19/04; B65H 75/18

[52] U.S. Cl. ..... 242/56.9; 242/72 R

[58] Field of Search ..... 242/56.9, 56.2–56.7, 242/72 R, 72 B, 72.1, 68, 68.4

[56] References Cited

U.S. PATENT DOCUMENTS

| | | | |
|---|---|---|---|
| 2,833,488 | 5/1958 | Kerber | 242/56.9 |
| 3,237,830 | 3/1966 | Oswald et al. | 242/56.9 X |
| 4,095,754 | 6/1978 | Campo | 242/56.9 X |

FOREIGN PATENT DOCUMENTS

| | | | |
|---|---|---|---|
| 1143074 | 1/1963 | Fed. Rep. of Germany | 242/56.9 |

*Primary Examiner*—John M. Jillions

*Attorney, Agent, or Firm*—Haseltine and Lake

[57] ABSTRACT

A universal shaft for the rewinding of adhesive tape-cut material is disclosed. The shaft comprises a tubular body with supporting elements carried thereon for board cores on which the adhesive tape-cut material is wound up. The supporting elements have a peripheral surface of a less width than that of the cores and are alternated with friction rings. Thereby the spacing between two successive supporting elements is the same as or less than the width of the smallest core. At one end the shaft has a hub with an extraction ring mounted thereon. Its position on the tubular body is adjustable by means of a series of spacers. The extraction rings and spacers are held together by a clamping sleeve or coupling.

2 Claims, 6 Drawing Figures

UNIVERSAL SHAFT FOR THE REWINDING OF ADHESIVE MATERIAL AS TAPE CUT ON SLITTING/RE-REELING MACHINE

This invention relates to a universal shaft for the rewinding of adhesive material that has been web- or tape-cut on known machines, such as slitting-re-reeling machine. The commercially available adhesive tapes, or more particularly pressure sensitive adhesive tapes, comprise a backing of suitable material (such as cellophane, PVC, polypropylene, polyester, etc.) in the form of a tape having at least one surface provided with a layer of adhesive material.

The production thereof is effected by making adhesive a sheet of a width in the range of 1–2 meters which is wound up on a beam and then, upon unwinding, providing for tailoring and rewinding the tapes obtained on suitable supporting cylinders, commonly referred to as cores, made of cardboard or other low cost material. To this end, slitting-re-reeling machines are used, in which the starting beam is unwound and to sheet cut by blades or different systems to provide tapes that are wound up on a pair of shafts on which a number of cores is carried. The tapes being obtained by the cutting or shearing operation are alternatively wound up on the two shafts and in order to speed up the production or output two additional shafts are provided on the machine for immediately replacing the wound up shafts that are removed, unloaded and provided with new cores as the second pair of shafts is wound up. Due to the different commercial sizes contemplated for the width of tapes that can be obtained by the slitting-re-reeling machine, the equipment of the latter should provide a total number of shafts which is four times the number of the desired sizes, plus the possible supply, as the known shafts are made for only one width of tape. Thus, said shafts provide a tubular body, on which rollers or cylinders are mounted for core support, as separated by friction rings integral with the shaft and pressed by a coaxial spiral spring.

The width of the rollers or cylinders is the same as that of the tape to be produced, for example 6, 9, 12, 15, 19, 25, 30, 38, 50 mm and theoretically may be replaced to adaptation to altered production requirements, but in practice the complicated operation and need of suitably adjusting each pair of shafts for alternate winding make such an operation unfeasible, so that it is normally preferred to provide the machine with a full set of at least four shafts for each size with a considerable cost, problems in storing, replacement of damaged parts and so on.

It is the object of the present invention to provide a universal shaft for the rewinding of cut tapes which can be used for a large number of tape widths without any substantial modification, but for the adjustment required for alternate winding.

It is a further object of the invention to provide a shaft, in which the cores are forced or pressure inserted with a slight elastic deformation of the supporting elements.

The invention will now be described in a preferred but not limiting embodiment with reference to the accompaying drawings, in which.

Referring to said figures of the accompanying drawings, a shaft 1 comprises a tubular metal body 2 of a length depending on the machine size, provided at the ends with two hubs 3 and 4, respectively. Hub 3 is for the rotary drive supplied by the machine and is of known type, depending on the slitting machine to which it is applied.

Figure 4:
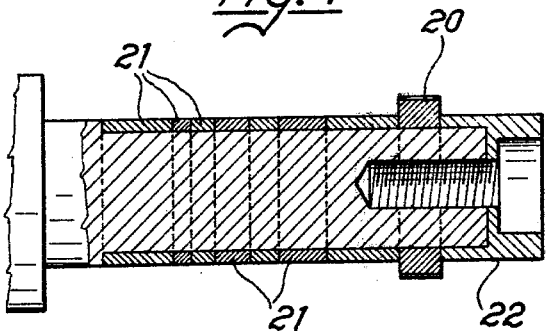
FIG. 4 is a sectional view showing the hub for positioning the cores on the shaft and adjusting the pitch.
Figure 5:
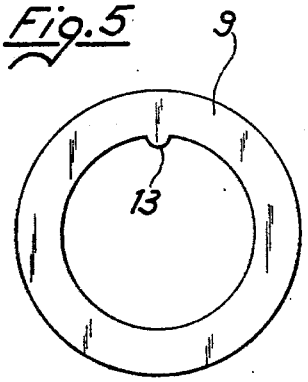
FIGS. 5 and 6 are plan and sectional views, respectively, showing a friction ring.
Figure 6:
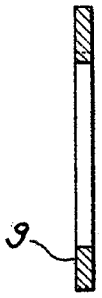

Hub 4, which will be more paticularly described in connection with FIG. 4, is for core positioning on the shaft and pitch adjustment. Said tubular body 2 has alternately carried thereon supporting elements 6 for cores 7 and separating friction rings 9, more particularly shown in FIGS. 2, 3 and 5,6, respectively. A thrust sleeve or coupling 10 and an adjusting ring nut 11, having a spiral or coil spring 12 interposed therebetween, allow to adjust the pressure being transmitted by said friction rings 9, which due to a tongue 13 are integral with the tubular body 2, to the supporting elements 6, which as a result are rotably driven with the shaft.

The supporting elements 6, to which the cores of cardboard or other material for the reels of tape to be wound up, comprise a perforated body or disc 15 having a same inner diameter as the outer diameter of the tubular body, from which a number of tabs or fins branches off, for example eight as shown in the figure, designated at 16, which are inclined (at 45° in the example shown) relative to the axis of said disc.

In the embodiment shown, the fins comprise a frustoconical surface portion 17, which is provided with eight equally spaced apart radial slits or slots 18, the whole being obtained by one-piece pressing of a material having high mechanical and elastic characteristics, such as nylon. The outer peripheral surface 19 of the fins is chamfered, so that it is parallel to the cylindrical surface of the tubular body, thus providing a bearing for said cores 7. By drawing the shaft in a suitable magazine, the cores are inserted and removed in the same direction, so that during loading operation the fins are approached to one another and compressed, then accordingly exerting an outward radial thrust on the cores, thereby preventing the latter from sliding on the supports or bearings.

The distance or spacing between two supporting elements and the width of the bearing surfaces 19 are suitably selected to assure a sufficient amount of bearing support for cores of a narrower width. Preferably, the supporting elements are of constant size and the spacing or distance between two of such elements may be changed or varied by using friction rings of different width or a plurality of juxtaposed rings. The distance or spacing between two consecutive supporting elements may be made equal to an entire submultiple of the width of the smallest core, or selected that each of the cores (particularly the narrowest cores) have a sufficient bearing.

Core loading is carried out in suitable automatic or semiautomatic manual loading devices, in which the shaft is placed at the begining of a set of cores and at a suitable distance and then drawn or pulled by a pneumatic piston engaging in the extracting hub 4 and uses an extraction ring 20 as stop reference.

Unloading is carried out similarly by causing the shaft to pass in the same magazine.

Figure 1:
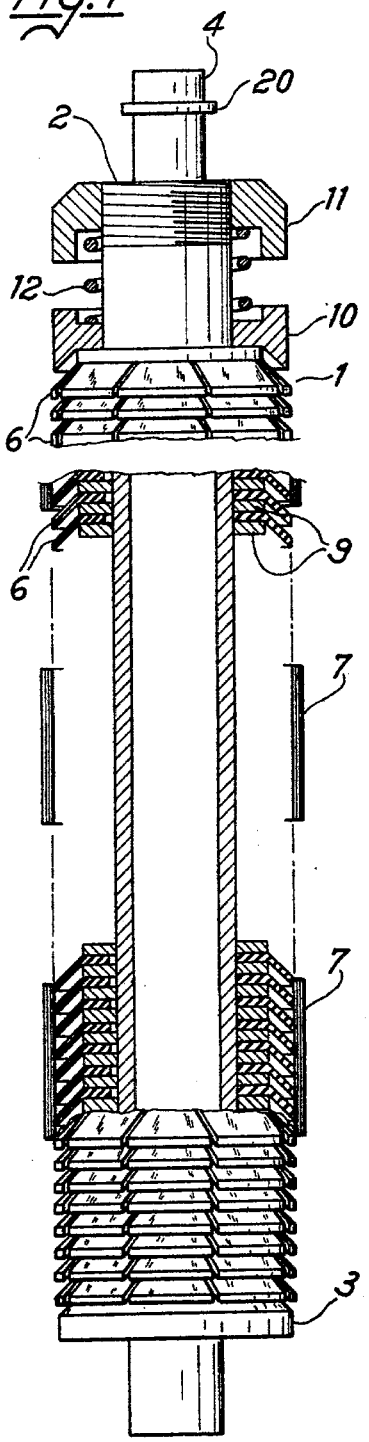
FIG. 1 shows the shaft according to the invention as partly cut away and in a sectional view at the central portion.
Figure 2:
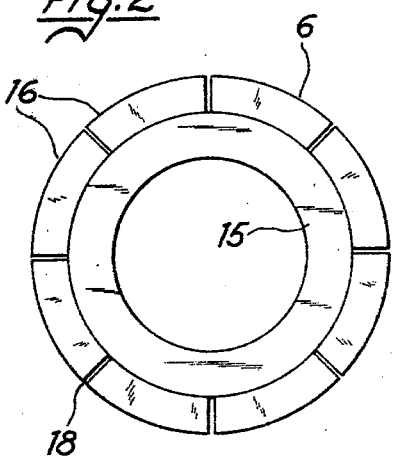
FIGS. 2 and 3 are plan and sectional views, respectively, showing a supporting element.
Figure 3:
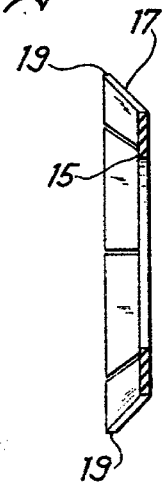

For the pitch change, that is to use cores of a different width, in addition to setting the magazine similarly as for the fixed pitch shaft, the position for the extraction ring 20 has to be modified by adding or removing some of the spacer rings 21 and clamping the assembly by means of a clamping sleeve 22. This is required, since the cut tape or film is at the same time wound up on two shafts, in which the cores are staggered to one another through a same distance as the size thereof, as shown in FIG. 1, and the set of differently sized spacer rings 21 is such as to provide said staggered arrangement on one or both of the shafts by displacing the reference comprising said extraction ring.

Although the invention has been described with reference to a particular embodiment, it should not be considered as limited thereto, as all of the modifications, particularly to the supporting elements, allowing to assure a multibearing for the cores on surfaces of less width than the size of the latter are within the scope of the invention.

What we claim is:

1. An improved universal shaft for rewinding tape cut adhesive material which has been on a slitting re-reeling machine, comprising; a tubular body having supporting elements thereon for receiving cardboard cores on to which the adhesive tape cut material is wound, friction discs arranged between adjacent supporting elements and being fastened to said shaft for rotating said supporting elements, spring means for biasing said friction discs into frictional engagement with said supporting elements, said improvement comprising: providing said supporting elements formed of rings of resilient material and being frusto conical in shape, said rings further being radially slit so as to form radially extending fins inclined with respect to a plane, normal to the shaft axis and having chamfered outer peripheral edges, whereby, the surface thereof is parallel to the inner wall of the cores, and said fins being pressed inwardly once the cores are inserted thereon so as to retain the cores by the elastic reaction of said fins.

2. A universal shaft according to claim 1, wherein: said shaft comprises at one end a hub having a removable ring mounted thereon, the position of which is axially adjustable by means of spacers so as to define a reference location for the operation of said shaft.

* * * * *